US011072753B2

(12) United States Patent
Nicolas et al.

(10) Patent No.: US 11,072,753 B2
(45) Date of Patent: Jul. 27, 2021

(54) DIESEL COMPOSITIONS WITH IMPROVED CETANE NUMBER AND LUBRICITY PERFORMANCES

(71) Applicant: RHODIA POLIAMIDA E ESPECIALIDADES S.A., Sao Paulo (BR)

(72) Inventors: Sébastien Nicolas, Hagley (GB); Fernanda Grigoletto, Campinas (BR); Sergio Martins, Campinas (BR)

(73) Assignee: RHODIA POLIAMIDA E ESPECIALIDADES S.A., São Paulo (BR)

( * ) Notice: Subject to any disclaimer, the term of this patent is extended or adjusted under 35 U.S.C. 154(b) by 0 days.

(21) Appl. No.: 15/742,124

(22) PCT Filed: Jul. 5, 2016

(86) PCT No.: PCT/IB2016/000952
§ 371 (c)(1),
(2) Date: Jan. 5, 2018

(87) PCT Pub. No.: WO2017/006167
PCT Pub. Date: Jan. 12, 2017

(65) Prior Publication Data

US 2018/0258356 A1 Sep. 13, 2018

(30) Foreign Application Priority Data

Jul. 6, 2015 (WO) ..... PCT/IB2015/001130

(51) Int. Cl.
*C10L 1/185* (2006.01)
*C10L 1/19* (2006.01)
(Continued)

(52) U.S. Cl.
CPC ..... *C10L 1/1855* (2013.01); *C10L 1/18* (2013.01); *C10L 1/19* (2013.01); *C10L 10/08* (2013.01);
(Continued)

(58) Field of Classification Search
CPC .. C10L 10/02; C10L 10/04; C10L 1/00; C10L 1/1855; C10L 2200/0423;
(Continued)

(56) References Cited

U.S. PATENT DOCUMENTS 2,252,889 A 8/1941 Haseltine
3,639,109 A * 2/1972 Badin ..... C10L 10/02 44/363
(Continued)

FOREIGN PATENT DOCUMENTS

CA 2391932 A1 5/2001
EP 1321502 A1 * 6/2003 ..... C10L 10/02
(Continued)

OTHER PUBLICATIONS

Miriam De Torres, Gonzalo Jiménez-Osés, Jose A.Mayoral, Elísabet Pires, Mario De Los Santos, Glycerol ketals: Synthesis and profits in biodiesel blends. Fuel, Apr. 2012, vol. 94, pp. 614-616.
(Continued)

*Primary Examiner* — Latosha Hines
(74) *Attorney, Agent, or Firm* — Osha Bergman Watanabe & Burton LLP

(57) ABSTRACT

The present invention aims a new diesel composition comprising a diesel fuel and from 0.01 to 0.8% by volume of a glycerol acetal or ketal. The new diesel composition shows a higher cetane number and better lubricity performances compared to known diesel compositions.

13 Claims, 2 Drawing Sheets

(51) Int. Cl.
*C10L 10/08* (2006.01)
*C10L 10/12* (2006.01)
*C10L 1/18* (2006.01)

(52) U.S. Cl.
CPC ..... *C10L 10/12* (2013.01); *C10L 2200/0476* (2013.01); *C10L 2270/026* (2013.01)

(58) Field of Classification Search
CPC ..... C10L 2200/0438; C10L 2200/0469; C10L 2200/0476; C10L 2270/02; C10L 2270/023; C10L 2270/026; C10L 1/18; C10L 1/1825; C10L 1/19; C10L 10/08; C10L 10/12
See application file for complete search history.

(56) References Cited

U.S. PATENT DOCUMENTS

| | | | | |
|---|---|---|---|---|
| 4,179,553 | A | 12/1979 | Hergenrother et al. | |
| 4,185,594 | A | 1/1980 | Perilstein | |
| 4,204,281 | A | 5/1980 | Hagemann | |
| 4,208,190 | A | 6/1980 | Malec | |
| 4,390,345 | A * | 6/1983 | Somorjai | C10L 1/14 44/352 |
| 4,428,182 | A | 1/1984 | Allen et al. | |
| 5,308,365 | A * | 5/1994 | Kesling, Jr. | C10L 1/026 44/443 |
| 7,374,589 | B2 | 5/2008 | Bernasconi et al. | |
| 7,789,918 | B2 | 9/2010 | Tuli et al. | |
| 10,711,215 | B1 * | 7/2020 | Harvey | C10L 1/18 |
| 2003/0163949 | A1 | 9/2003 | Delfort et al. | |
| 2004/0237385 | A1 | 12/2004 | Bongardt et al. | |
| 2009/0270643 | A1 | 10/2009 | Kousemaker et al. | |
| 2015/0113860 | A1 * | 4/2015 | De Angelis | C07D 317/22 44/352 |

FOREIGN PATENT DOCUMENTS

| | | | | |
|---|---|---|---|---|
| EP | 1230328 | B1 | 10/2004 | |
| FR | 2772784 | A1 | 6/1999 | |
| WO | 9623855 | A1 | 8/1996 | |
| WO | 9804656 | A1 | 2/1998 | |
| WO | 0136568 | A1 | 5/2001 | |
| WO | 03020851 | A1 | 3/2003 | |
| WO | 2006-084048 | A1 | 8/2006 | |
| WO | 2006084048 | A1 | 8/2006 | |
| WO | 2008031965 | A1 | 3/2008 | |
| WO | WO-2008031965 | A1 * | 3/2008 | C10L 1/026 |
| WO | 2013-150457 | A1 | 10/2013 | |
| WO | 13150457 | A1 | 10/2013 | |

OTHER PUBLICATIONS

Vera L.P. Soares, et al. New applicationsfor soybean biodiesel glycerol. Soybean—Applications and Technology, Apr. 2011, pp. 158-159.

First Office Action dated Jul. 11, 2019, issued in corresponding Chinese Patent Application No. 201680039973.3, with English translation (13 pages).

* cited by examiner

DIESEL COMPOSITIONS WITH IMPROVED CETANE NUMBER AND LUBRICITY PERFORMANCES

CROSS-REFERENCE TO RELATED APPLICATIONS

The present application is a U.S. national stage entry under 35 U.S.C. § 371 of International Application No. PCT/162016/000952, filed Jul. 5, 2016, which claims priority to International Application No. PCT/162015/001130 filed on Jul. 6, 2015, the entire content of these applications being incorporated herein by reference for all purposes.

FIELD OF THE INVENTION

The present invention relates to a new diesel composition containing a specific low quantity of glycerol ketal or acetal as an additive improving the cetane number and lubricity performances of the diesel composition.

BACKGROUND OF THE INVENTION

Cetane number or CN is an indicator of the combustion speed of diesel fuel.

Cetane number is an inverse function of a fuel's ignition delay, and the time period between the start of injection and the first identifiable pressure increase during combustion of the fuel. In a particular diesel engine, higher cetane fuels will have shorter ignition delay periods than lower cetane fuels.

In short, the higher the cetane number the more easily the fuel will combust in a compression setting (such as a diesel engine). Therefore higher-cetane fuel usually causes an engine to run more smoothly and quietly.

Generally, diesel engines operate well with a CN from 40 to 55. Fuels with higher cetane number have shorter ignition delays, providing more time for the fuel combustion process to be completed. Hence, higher speed diesel engines operate more effectively with higher cetane number fuels.

In Europe, diesel cetane numbers were set at a minimum of 38 in 1994 and 40 in 2000. The current standard for diesel sold in European Union, Iceland, Norway and Switzerland is set in EN 590, with a minimum cetane index of 46 and a minimum cetane number of 51. Premium diesel fuel can have a cetane number as high as 60.

In North America, most states adopt ASTM D975 as their diesel fuel standard and the minimum cetane number is set at 40, with typical values in the 42-45 range. Premium diesels may or may not have higher cetane, depending on the supplier. Premium diesel often use additives to improve CN and lubricity, detergents to clean the fuel injectors and minimize carbon deposits, water dispersants, and other additives depending on geographical and seasonal needs. California diesel fuel has a minimum cetane of 53. Under the Texas Low Emission Diesel (TxLED) program there are 110 counties where diesel fuel must have a cetane number of 48 or greater, or else must use an approved alternative formulation or comply with the designated alternative limits.

Biodiesel from vegetable oil sources have been recorded as having a cetane number range of 46 to 52, and animal-fat based biodiesels cetane numbers range from 56 to 60. Dimethyl ether is a potential diesel fuel as it has a high cetane rating (55-60) and can be produced as a biofuel.

Accurate measurements of the cetane number are rather difficult, as it requires burning the fuel in a rare diesel engine called a Cooperative Fuel Research (CFR) engine, under standard test conditions. The operator of the CFR engine uses a hand-wheel to increase the compression ratio (and therefore the peak pressure within the cylinder) of the engine until the time between fuel injection and ignition is 2.407 ms.

The resulting cetane number is then calculated by determining which mixture of cetane (hexadecane) and isocetane (2,2,4,4,6,8,8-heptamethylnonane) will result in the same ignition delay.

The industry standard for measuring cetane number is ASTM D-613 (ISO 5165).

Usual additives to raise the cetane number are Alkyl nitrates, mainly 2-ethylhexyl nitrate and di-tert-butyl peroxide. 2-ethylhexyl nitrate is classified as dangerous for environment, toxic to aquatic life with long last lasting effects, acute toxicity and harmful in contact with skin, if swallowed or by inhalation. di-tert-butyl peroxide has acute, aquatic toxicity, chronic aquatic toxicity and germ cell mutagenicity.

The CN is an important factor in determining the quality of diesel fuel, but not the only one; other measurements of diesel's quality include (but are not limited to) energy content, density, lubricity, cold-flow properties and sulphur content.

Lubricity is the measure of the reduction in friction and/or wear by a lubricant.

The lubricity of a substance is not a material property, and cannot be measured directly. Tests are performed to quantify a lubricant's performance for a specific system. This is often done by determining how much wear is caused to a surface by a given wear-inducing object in a given amount of time. Other factors such as surface size, temperature, and pressure are also specified. For two fluids with the same viscosity, the one that results in a smaller wear scar is considered to have higher lubricity. For this reason lubricity is also termed a substance's anti-wear property.

In a modern diesel engine, the fuel is part of the engine lubrication process. Diesel fuel naturally contains compounds that provide lubricity, but because of regulations in many countries (such as the US and the EU), sulphur must be removed from the fuel before it can be sold, and the hydrotreatment of diesel fuel to remove sulphur also removes the compounds that provide lubricity. Reformulated diesel fuel that does not have biodiesel added has a lower lubricity and requires lubricity improving additives to prevent excessive engine wear.

A suitable diesel fuel lubricity standard has been established by using the HFRR method (ISO 12156-1 standard): the HFRR wear scar diameters (WSD) obtained after testing a diesel fuel must be lower than 460 μm to ensure that this fuel has sufficient lubricity. When necessary, better lubricity can be restored easily by adding additives. However, these additives must have good physical and chemical stability alone or after incorporation in multifunctional formulation. They must also be fully compatible with other additives that may be present in the fuel such as flow improvers, wax antisettling additives, detergents etc.

To verify this physical and chemical compatibility and to ensure that each additive maintain its full efficiency after being mixed with others in multifunctional formulations or in fuel itself, no harm tests are carried out.

A number of types of additives have already been proposed in order to improve lubricity of diesels. Antiwear additives have thus been added to diesel fuels, some of these being known in the field of lubricant, as for example, fatty acid esters and unsaturated fatty acid dimers, aliphatic amines, esters of fatty acids, diethanolamine and long chain aliphatic monocarboxylic acids, as described in U.S. Pat. Nos. 2,252,889, 4,185,594, 4,204,481, 4,208,190 and 4,428, 182. Most of these additives exhibit a sufficient lubricating power, but at very high concentrations, and this is economically highly disadvantageous for purchase. U.S. Pat. No. 7,789,918 discloses a lubricity improver composition for use in low sulfur diesel comprising of 0.1-10% by weight of ester derivative derived from cashew nut shell liquid (CNSL esters). WO 0136568, EP 1230328, JP 2003 5149537 describe inventions related to additive mixture comprising of a) reaction product formed after reaction of a dicarboxylic acid or a derivative thereof with a long chain, aliphatic amine b) natural fatty acid ester, c) the use of said additive mixture for improving the lubricity of fuels and for improving engine resistance to wear, in addition to fuel and lubricant compositions containing said additive mixtures. Several other patents which describe the use of additive for low sulfur diesel are WO 03/020851, WO 96/23855, WO 98/04656 and FR 2772 784 A.

In US2003/0163949, it is proposed to use large quantities of glycerol acetals and ethers thereof as additives or as formulation bases for gas oils and leading to significant reductions in particulate emissions. Ethers tend to form unstable peroxides when exposed to oxygen. Ethyl, isobutyl, ethyl tert-butyl, and ethyl tert-pentyl ether are particularly hazardous in this respect.

One of the objects of the invention is to propose an improved diesel composition. In particular, this invention aims to provide a higher cetane number composition which has also better lubricity behavior.

A further object of the invention was to propose a cetane booster and/or lubricity improver, which was effective at lower dosage.

Another objective of the present invention is to propose a cetane booster and/or lubricity improver that is at least partially originated from bi-resources.

SUMMARY OF THE INVENTION

The invention thus proposes a diesel composition comprising at least one diesel fuel and from 0.01 to 0.8% by volume of at least one compound of formula I below:

(I)

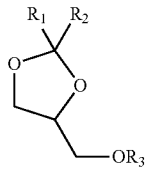

wherein $R_1$ and $R_2$, independently from one another, are selected in the group consisting of: a linear or branched C1-C12 alkyl, a C4-C12 cycloalkyl or an aryl.

$R_3$ is H, a linear or branched alkyl, a cycloalkyl or a —C(=O)$R_4$ group, with $R_4$ being a linear or branched C1-C4 alkyl or a C5-C6 cycloalkyl.

The present invention also proposes the use of at least one compound of formula I described above according to all the possible embodiments and combinations thereof to increase the cetane number of a diesel composition, the lubricity of a diesel composition or both the cetane number and the lubricity of a diesel composition.

DETAILED DESCRIPTION OF THE INVENTION

The diesel composition of the invention comprises at least one diesel fuel and from 0.01 to 0.8% by volume of at least one compound of formula I below:

(I)

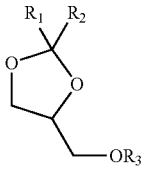

wherein $R_1$ and $R_2$, independently from one another, are selected in the group consisting of: a linear or branched C1-C12 alkyl, a C4-C12 cycloalkyl or an aryl.

$R_3$ is H, a linear or branched alkyl, a cycloalkyl or a —C(=O)$R_4$ group, with $R_4$ being a linear or branched C1-C4 alkyl or a C5-C6 cycloalkyl.

By "from 0.01 to 0.8% by volume", it is understood that this amount is based on the total volume of the diesel composition.

In a preferred embodiment, $R_1$ and $R_2$, independently from one another, are selected in the group consisting of: methyl, ethyl, isopropyl, n-propyl, isobutyl, n-butyl, tert-butyl, n-pentyl, cyclopentyl, cyclohexyl or phenyl.

Advantageously, in formula I above $R_3$ is H or a —C(=O)$R_4$ group, with $R_4$ being methyl, ethyl, isopropyl, n-propyl, isobutyl, n-butyl or tert-butyl. More preferably, $R_3$ is H.

One preferred embodiment is when R1 and R2 are methyl and R3 is H. In this case, the compound is commercially available, for example under the name Augeo® Clean Multi, Augeo® SL191 or Solketal. This compound can be synthesized by reaction between glycerol and acetone, under well-known classical conditions.

In another embodiment, R1 is methyl, R2 is isobutyl and R3 is H. In this case, the compound is commercially available, for example under the name Augeo® Clean Plus or Augeo® Film. This compound can be synthesized by reaction between glycerol and methyl-isobutyl ketone, under well-known classical conditions.

In a third embodiment, R1 is methyl, R2 is phenyl and R3 is H. In this case, the compound is commercially available, for example under the name Augeo® Film HB. This compound can be synthesized by reaction between glycerol and acetophenone, under well-known classical conditions.

Another possibility is to have R1 and R2 are methyl and R3 is a —C(=O)R4 group, with R4 being methyl. In this case, the compound is commercially available, for example under the name Augeo® ACT. This compound can be synthesized by transesterification of Solketal with an alkyl acetate under well-known classical conditions.

Glycerol can be obtained as a coproduct from biodiesel production during the transesterification of triglycerides.

The compounds of formula I of the invention, have very good performance in the application, low odor and no toxicity to humans or environment. In addition, their use induces no security issues because of their high flash point.

They are sustainable alternatives to existing cetane and lubricity improvers in diesel application as they meet the three pillars of sustainability (economical, environmental and social).

It is also a favorable embodiment when a blend of two or more compounds of formula I is used in the diesel composition according to the invention. This blend preferably comprises Augeo® Clean Multi and Augeo® Clean Plus, in a weight ratio from about 30:70 to 70:30, and even more preferably 50:50. Another advantageous blend comprises Augeo® Clean Plus and Augeo® ACT, in a weight ratio from about 30:70 to 70:30, and even more preferably 60:40.

In the diesel composition according to the invention, it is particularly preferred to have the compound of formula I present in an amount of 0.05 to 0.5% by volume of the total volume of the diesel composition.

The diesel fuel can comprises a diesel fuel of petroleum origin or a mixture of alkylic esters derived from vegetable oils.

The present invention also proposes the use of at least one compound of formula I described above according to all the possible embodiments and combinations thereof to increase the cetane number of a diesel composition, the lubricity of a diesel composition or both the cetane number and the lubricity of a diesel composition.

The introduction of the compound of formula I above into gas oil and/or into a mixture of vegetable oil esters leads to diesel motor fuels making it possible to increase the cetane number and the lubricity performance with respect to a fuel not containing the products in question.

The following examples illustrate the invention in a nonlimiting way.

EXAMPLES

Methods of Measure

For the examples below, the parameters have been measured according to the standards indicated in the below table I.

TABLE I

| methods of measure | |
|---|---|
| Analyses | Legislation |
| Density - 15° C. (kg/m3) | NF EN ISO 12185 |
| Sulfur Content (mg/kg) | NF EN ISO 20846 |
| Water Content (mg/kg) | NF EN ISO 12937 |
| Lubricity (μm) | NF EN ISO 12156-1 |
| Cold Flow Temp. (° C.) | NF EN 116 |
| Cetane Number | NF EN ISO 5165 |
| Viscosity at 40° C. (mm2/s) | NF EN ISO 3104 |

Tests and Results

Cetane number and lubricity results have been measured for different types of diesel, including biodiesel, after the addition of Augeo SL191 or other Augeo components and a reasonable time of stirring (approximately ten minutes), to homogenize the solution.

Example 1

Gazole Biofree EN590

Gazole Biofree EN590, also known as EN590 BO, it is a ultra low sulfur diesel, without the bio-component (biodiesel or FAME=fatty acid methyl ester). It is a traded cut globally, commercially available mainly in Europe. The table II below indicates its main specifications.

TABLE II

| Property | Unit | Lower limit | Upper limit | Test method |
|---|---|---|---|---|
| Cetane index | | 46.0 | — | EN ISO 4264 |
| Cetane number | | 51.0, | — | EN ISO 5165 |
| Density at 15° C. | kg/m$^3$ | 820 | 845 | EN ISO 3675, EN ISO 12185 |
| Polycyclic aromatic hydrocarbons | % (m/m) | — | 11 | EN ISO 12916 |
| Sulphur content | mg/kg | — | 10.0 | EN ISO 20846, EN ISO 20884 |
| Flash point | ° C. | Above 55 | — | EN ISO 2719 |
| Carbon residue (on 10% distillation residue) | % m/m | — | 0.30 | EN ISO 10370 |
| Ash content | % (m/m) | — | 0.01 | EN ISO 6245 |
| Water content | mg/kg | — | 200 | EN ISO 12937 |
| Total contamination | mg/kg | — | 24 | EN ISO 12662 |
| Copper strip corrosion (3 hours at 50° C.) | rating | Class 1 | Class 1 | EN ISO 2160 |
| Oxidation Stability | g/m$^3$ | — | 25 | EN ISO 12205 |
| Lubricity, corrected wear scar diameter (wsd 1, 4) at 60° C. | μm | — | 460 | EN ISO 12156-1 |
| Viscosity at 40° C. | mm$^2$/s | 2.00 | 4.50 | EN ISO 3104 |
| Distillation recovered at 250° C., 350° C. | % V/V | 85 | <65 | EN ISO 3405 |
| 95%(V/V) recovered at | ° C. | — | 360 | |
| Fatty acid methyl ester content | % (V/V) | — | 7 | EN 14078 |
| Viscosity at 40° C. | mm$^2$/s | 2.00 | 4.50 | EN ISO 3104 |

Ex 1

Augeo SL191 was added in the concentrations indicated below, and the cetane number was measured according with the standard already mentioned. The table III below indicates the results obtained.

TABLE III

| Gazole Biofree EN590 | |
|---|---|
| % (v/v) Augeo SL191 | Legislation NF EN ISO 5165 Cetane Number |
| 0.00 | 53.5 |
| 0.04 | 53.7 |
| 0.08 | 54.3 |
| 0.12 | 54.8 |
| 0.16 | 55.1 |
| 0.23 | 55.2 |

Figure 1:
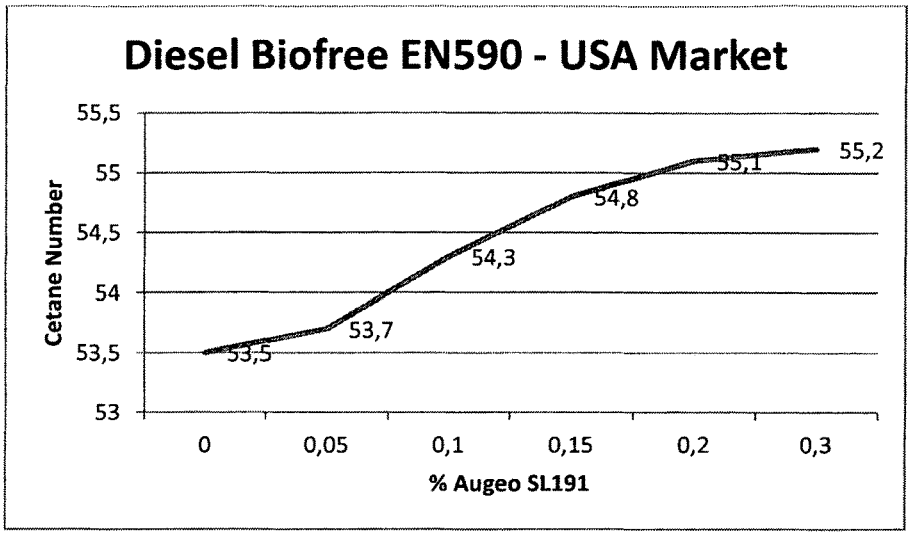
FIGS. 1 to 3 correspond to cetane number measurement diagrams as a function of the quantity of Augeo® SL191 added for three different diesel fuels. Those figures are related to Examples 1 to 3.

The diagram of this example is presented on FIG. 1.

Ex1bis

Augeo Film (formula I wherein R1 is methyl, R2 is isobutyl and R3 is H) was added in the concentrations indicated below, and the cetane number was measured according with the standard already mentioned. The table IIIbis below indicates the results obtained.

TABLE IIIbis

| Gazole Biofree EN590 | |
|---|---|
| % (v/v) Augeo Film | Legislation NF EN ISO 5165 Cetane Number |
| 0.00 | 54.2 |
| 0.48 | 55.9 |

Ex1ter

Augeo Film HB (formula I wherein R1 is methyl, R2 is phenyl and R3 is H) was added in the concentrations indicated below, and the cetane number was measured according with the standard already mentioned. The table IIIter below indicates the results obtained.

TABLE IIIter

| Gazole Biofree EN590 | |
|---|---|
| % (v/v) Augeo Film HB | Legislation NF EN ISO 5165 Cetane Number |
| 0.00 | 54.2 |
| 0.55 | 55.7 |

Example 2

Gazole Biofree US

This type of diesel specifications are mentioned in ASTM D975 ULSD, and it also has no FAME content. The cetane number specification is minimum 40.

Augeo SL191 was added in the concentrations indicated below, and the cetane number was measured according with the standard already mentioned. The table IV below indicates the results obtained.

TABLE IV

| Gazole Biofree US | |
|---|---|
| % (v/v) Augeo SL191 | Legislation NF EN ISO 5165 Cetane Number |
| 0.00 | 46.7 |
| 0.16 | 48.8 |

Figure 2:
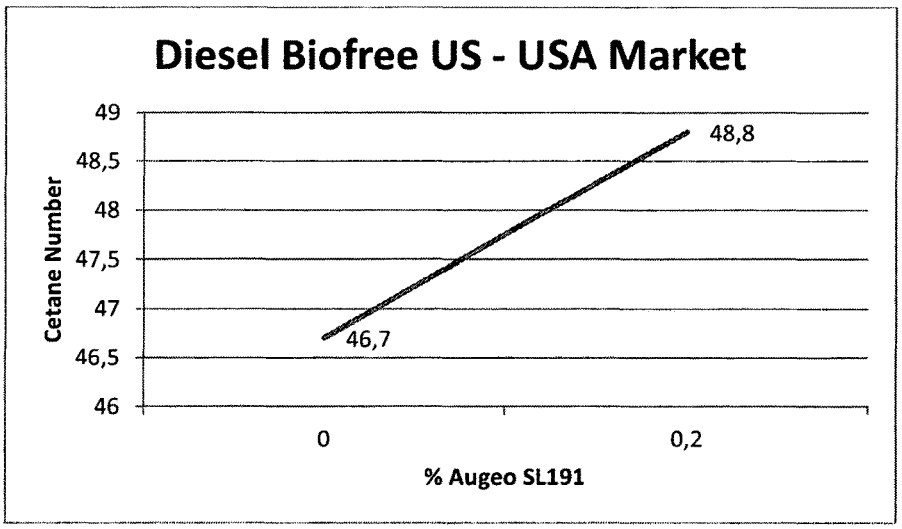

The diagram of this example is presented on FIG. 2.

Example 3

Biodiesel

Biodiesel is also known as FAME, fatty acid methyl ester, and its specifications are mentioned at standard EN ISO 14214.

Augeo SL191 was added in the concentrations indicated below, and the cetane number was measured according with the standard already mentioned. The table V below indicates the results obtained.

TABLE V

| FAME | |
|---|---|
| % (v/v) Augeo SL191 | Details Biodiesel Legislation NF EN ISO 5165 Cetane Number |
| 0.00 | 54.5 |
| 0.04 | 55.5 |

Figure 3:
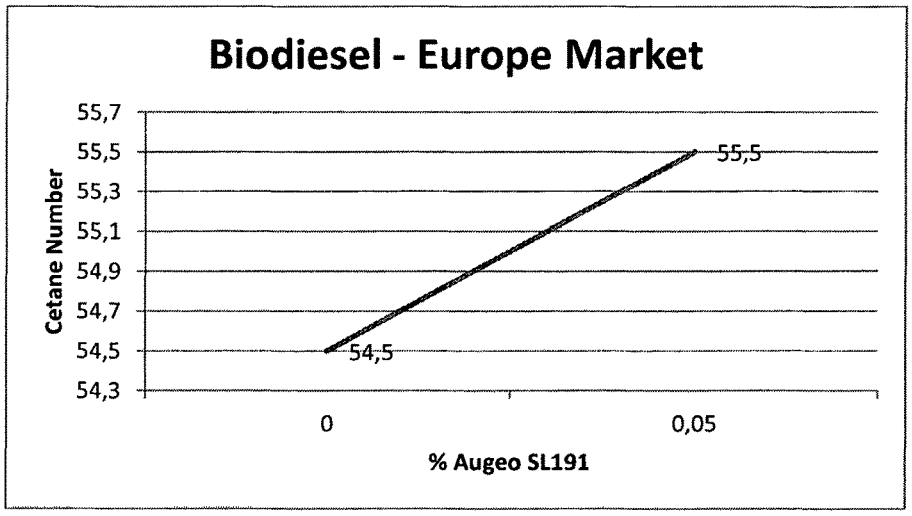

The diagram of this example is presented on FIG. 3.

Example 4

Ultra Low Sulfur Diesel

This type of diesel requirement is ultra-low sulfur content, and the specific value will depend on the region. In USA the limit is 15 ppm, while in Europe is 10 ppm (as indicated in EN590). The table VI below is showing the results obtained for this diesel when in presence of Augeo SL191 as an additive.

TABLE VI

| ULSD 10 ppm | | | |
|---|---|---|---|
| | | Details "Ultra Low Sulfur Diesel" - Europe | |
| Analyses | Legislation | 0% Augeo SL191 (v/v) | 0.4% Augeo SL191 (v/v) |
| Density - 15° C. (kg/m3) | NF EN ISO 12185 | 839.0 | 839.6 |
| Sulfur Content (mg/kg) | NF EN ISO 20846 | 9.0 | 7.8 |
| Water Content (mg/kg) | NF EN ISO 12937 | 30.0 | 40.0 |
| Lubricity (μm) | NF EN ISO 12156-1 | 379.0 | 369.0 |
| Cold Flow Temp. (° C.) | NF EN 116 | −20.0 | −19.0 |
| Cetane Number | NF EN ISO 5165 | 52.6 | 54.6 |
| Viscosity at 40° C. (mm2/s) | NF EN ISO 3104 | 2.7 | 2.7 |

Figure 4:
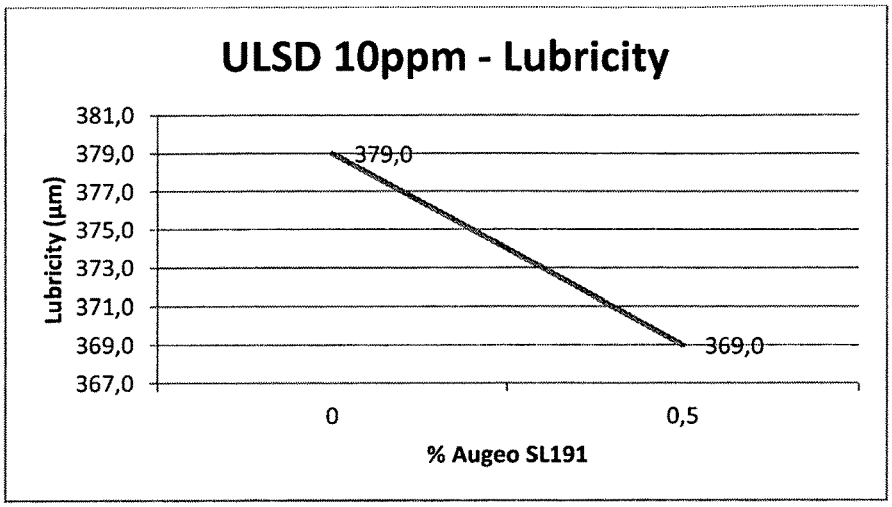
FIGS. 4, 5 and 6 are respectively lubricity, cetane number and sulfur content measurement diagrams as a function of the quantity of Augeo® SL191 added into a diesel fuel described in Example 4.
Figure 5:
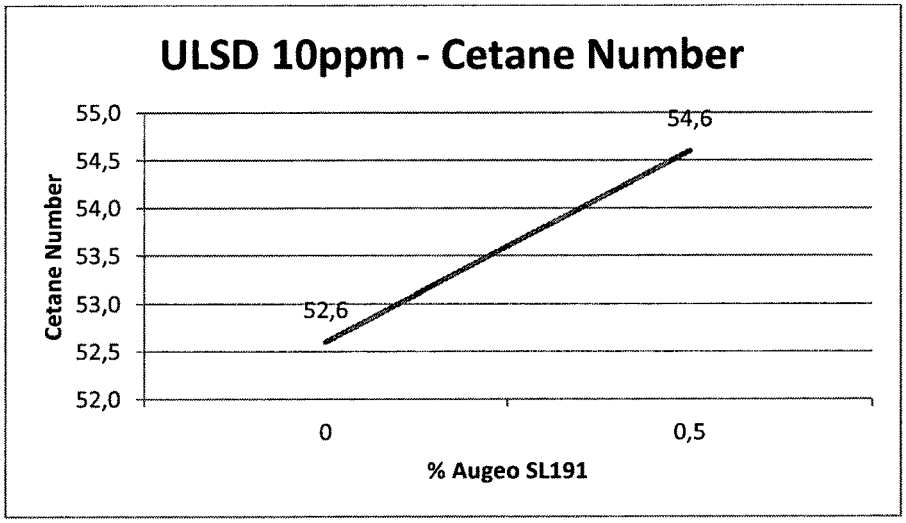
Figure 6:
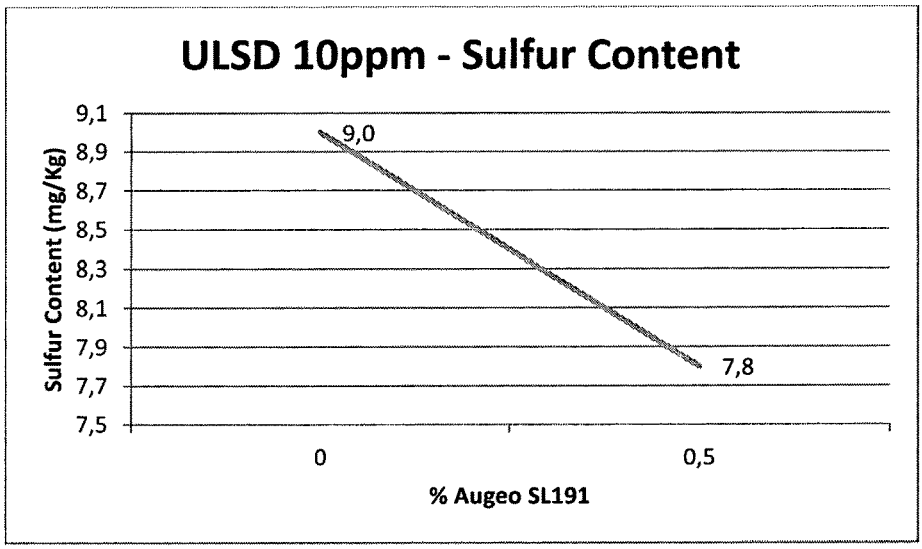

The diagram of this example is presented on FIGS. 4, 5 and 6.

The above results show that at very low dosage, as is being proposed, the component of Formula I is able to improve not only the cetane number of different types of diesel commercially available in the market, but also the lubricity.

The invention claimed is:

1. A diesel composition, comprising at least one diesel fuel and from 0.05 to 0.5% by volume of a total volume of the diesel composition of at least one compound according to formula I:

(I)

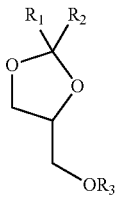

wherein:

$R_1$ and $R_2$, independently from one another, are selected from the group consisting of linear or branched $C_1$-$C_{12}$ alkyl, $C_4$-$C_{12}$ cycloalkyl, and aryl, and $R_3$ is H, a cetane number of the diesel composition containing the at least one compound according to formula I is higher than a cetane number of the diesel composition not containing the said compound, and the diesel fuel has a sulfur content of less than 15 ppm.

2. A diesel composition according to claim 1, wherein $R_1$ and $R_2$, independently from one another, are selected from the group consisting of methyl, ethyl, isopropyl, n-propyl, isobutyl, n-butyl, tert-butyl, n-pentyl, cyclopentyl, cyclohexyl, and phenyl.

3. A diesel composition according to claim 1, wherein $R_1$ and $R_2$ are methyl.

4. A diesel composition according to claim 1, wherein $R_1$ is methyl, $R_2$ is isobutyl.

5. A diesel composition according to claim 1, wherein $R_1$ is methyl, $R_2$ is phenyl.

6. A diesel composition according to claim 1, comprising a blend of two or more compounds according to formula I.

7. A diesel composition according to claim 1, wherein said diesel fuel comprises a diesel fuel of petroleum origin.

8. A diesel composition according to claim 1, wherein said diesel fuel comprises a mixture of alkylic esters derived from vegetable oils.

9. A method for increasing the cetane number of a diesel fuel, comprising adding to such diesel fuel from 0.05 to 0.5% by volume of at least one compound according to formula I:

(I)

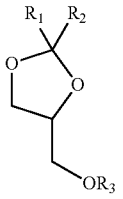

wherein:

$R_1$ and $R_2$, independently from one another, are selected from the group consisting of linear or branched $C_1$-$C_{12}$ alkyl, $C_4$-$C_{12}$ cycloalkyl, and aryl, and $R_3$ is H, the cetane number of the diesel fuel containing the at least one compound is higher than the cetane number of the diesel fuel not containing such compound, and the diesel fuel has a sulfur content of less than 15 ppm.

10. A method for increasing the lubricity of a diesel fuel, comprising adding to such diesel fuel from 0.05 to 0.5% by volume of at least one compound according to formula I:

(I)

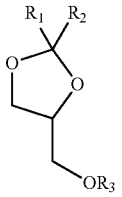

wherein:

$R_1$ and $R_2$, independently from one another, are selected from the group consisting of linear or branched $C_1$-$C_{12}$ alkyl, $C_4$-$C_{12}$ cycloalkyl, and aryl, and $R_3$ is H, the lubricity of the diesel fuel containing the at least one compound is higher than the lubricity of the diesel fuel not containing such compound, and the diesel fuel has a sulfur content of less than 15 ppm.

11. A method for increasing both the cetane number and the lubricity of a diesel fuel, comprising adding to such diesel fuel from 0.05 to 0.5% by volume of at least one compound according to formula I:

(I)

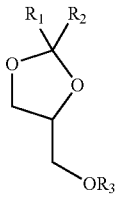

wherein:

$R_1$ and $R_2$, independently from one another, are selected from the group consisting of linear or branched $C_1$-$C_{12}$ alkyl, $C_4$-$C_{12}$ cycloalkyl, and aryl, and $R_3$ is H, and wherein:

the cetane number of the diesel fuel containing the at least one compound is higher than the cetane number of the diesel fuel not containing such compound, the lubricity of the diesel fuel containing the at least one compound is higher than the lubricity of the diesel fuel not containing such compound, and the diesel fuel has a sulfur content of less than 15 ppm.

12. A diesel composition according to claim 1, wherein a concentration of the at least one compound according to formula I is selected within the concentration range of claim 1 to increase the cetane number of the diesel composition.

13. A diesel composition according to claim 1, wherein the diesel fuel has a sulfur content of less than 10 ppm.

* * * * *